US005806996A

United States Patent [19]

Leys et al.

[11] Patent Number: 5,806,996

[45] Date of Patent: Sep. 15, 1998

[54] THERMAL PRINTER WITH ADJUSTABLE THERMAL HEAD

[75] Inventors: Paul Leys, Kontich; Danny Verbeek, Heist op den Berg, both of Belgium

[73] Assignee: Agfa-Gevaert, Mortsel, Belgium

[21] Appl. No.: 851,942

[22] Filed: May 6, 1997

Related U.S. Application Data

[] Provisional application No. 60/020,784 Jun. 28, 1996.

[30] Foreign Application Priority Data

May 9, 1996 [EP] European Pat. Off. ..... 96201254

[51] Int. Cl.[6] ..... B41J 2/315

[52] U.S. Cl. ..... 400/120.16; 400/120.17; 347/197; 347/198

[58] Field of Search ..... 400/120.16, 120.17, 400/120.01, 55, 56, 57; 347/197, 198

[56] References Cited

U.S. PATENT DOCUMENTS 4,560,292 12/1985 Takahashi ..... 400/120.16
4,718,785 1/1988 Spath ..... 400/120.16
4,750,880 6/1988 Stephenson et al. ..... 400/55
4,962,392 10/1990 Okuno et al. ..... 347/197
5,023,628 6/1991 Koch ..... 346/76 PH
5,422,660 6/1995 Oikawa ..... 347/198

FOREIGN PATENT DOCUMENTS 60206690 10/1985 European Pat. Off. .

*Primary Examiner*—Edgar S. Burr
*Assistant Examiner*—Anthony H. Nguyen
*Attorney, Agent, or Firm*—Baker & Botts, L.L.P.

[57] ABSTRACT

Thermal printer with a thermal head including an array of juxtaposed heating elements for line-wise heating a sheet to produce an image, and a rotatable printing drum for conveying the sheet past the thermal head while the thermal head is biased towards the printing drum, which is provided with a rotatable cam and a reference face for adjusting the position of the thermal head with respect to the printing drum.

7 Claims, 5 Drawing Sheets

THERMAL PRINTER WITH ADJUSTABLE THERMAL HEAD

BACKGROUND OF THE INVENTION

1. Field of the Invention

The present invention relates to a thermal printer with a thermal head for line-wise and image-wise heating a sheet to produce an image.

2. Description of the Prior Art

Thermal imaging or thermography is a recording process wherein images are generated by the use of image-wise modulated thermal energy.

In thermography two approaches are known:

1. Direct thermal formation of a visible image pattern by image-wise heating of a recording material containing matter that by chemical or physical process changes colour or optical density.
2. Thermal dye transfer printing wherein a visible image pattern is formed by transfer of a coloured species from an image-wise heated donor element onto a receptor element.

A survey of "direct thermal" imaging methods is given in the book "Imaging systems" by Kurt I. Jacobson-Ralph E. Jacobson, The Focal Press—London and New York (1976), Chapter VII under the heading "7.1 Thermography". Thermography is concerned with materials which are not photosensitive, but are sensitive to heat. Image-wise applied heat is sufficient to bring about a visible change in a thermosensitive imaging material.

Common thermal printers comprise a rotatable drum and an elongate thermal head which is spring-biased towards the drum to firmly line-wise contact a heat-sensitive material which is passed between the head and the drum.

The thermal head includes a plurality of heating elements equal in number to the number of pixels in the image data present in a line memory, and corresponding drivers and shift registers for these elements. The image-wise heating of a sheet is performed on a line by line basis, with the heating resistors geometrically juxtaposed along each other in a bead-like row running parallel to the axis of the drum. Each of these resistors is capable of being energised by heating pulses, the energy of which is controlled in accordance with the required density of the corresponding picture element.

In direct thermal image formation, a single heat-sensitive sheet is conveyed between the thermal head and the drum, and the image is directly produced in the sheet. The sheet usually is not attached to the drum but is conveyed between the head and the drum by frictional contact of its rearside with the drum.

In thermal dye transfer the sheet, i.e. the image receiving sheet, is usually attached to the rotatable drum, and a dye donor sheet or web is conveyed by frictional contact with the rotating sheet past the thermal head. In colour printing, as one colour separation has been printed, the drum is rotated to its initial angular position, a different dye donor sheet, or dye donor field on a web, is located between the sheet and the thermal head and the second separation image is printed in register on the first one. This operation is repeated for the third colour separation, and occasionally a fourth time for printing a black-and-white image.

In practising the thermal printing technique described hereinbefore, the image quality may be spoiled by a defect which will be called "banding" hereinafter, and which is characterised by transverse zones (i.e. parallel with the thermal head) on the final print of slightly increased and/or reduced optical density which are particularly visible in the areas of lower optical density, say smaller than 1.0. A known cause for this type of defect is the driving system for the sheet which can cause minute accelerations and decelerations leading to corresponding reductions and prolongations of the printing time. However, extensive studies of the system learned us that in spite of almost ideal driving characterics the mentioned defect, be it to a lesser degree, still persists.

Another cause for this defect is formed by surface defects of the print drum. The print drum usually has a resilient covering of rubber or the like which, as practice shows, can have slight depressions or elevations (order of magnitude up to 10 $\mu$m) running parallel to the drum axis and causing a momentary angular position change of the sheet with respect to the heating elements of the thermal head.

These heating elements are formed by juxtaposed tiny electrical resistors deposited on a thermally insulating support in the form of an elongate bead, usually made of glass. The heating elements become heated by an appropriate amount of electrical current.

We have also found that in practice the exact location of the heating elements on their support can differ in the transverse direction of the head, i.e. a direction normal to its elongate direction, from one head to the other, and we have found that this difference in location can amplify the consequences on the image quality of the described drum defect.

It is possible to select the print drums and the thermal heads more severely for their ideal characteristics, but this goes at the expense of an increased costprice.

SUMMARY OF THE INVENTION

Object of the Invention

It is the object of the present invention to provide a thermal printer which allows to produce thermal images with much less banding than with known printers, and this without need for using print drums and thermal heads with very narrow production tolerances.

Statement of Invention

Thermal printer with a thermal head comprising a plurality of heating elements juxtaposed in an elongate array, a rotatable print drum for conveying a sheet past such heating elements while they are urged towards such sheet on the drum, and means for adjusting the relative position of said thermal head with respect to said print drum, in a direction forward or rearward with respect to the direction of advance of such sheet, characterised in that said thermal printer comprises:

a main frame in which said printing drum is rotatably mounted and a sub-frame in which said thermal head is mounted, said sub-frame being movable relatively to the print drum in a direction tangential thereto, spring means for biasing said sub-frame in one sense of said tangential direction, and adjustable stop means on said sub-frame which can abut against a corresponding reference face of the main frame, under the bias of said spring means.

The notion "the sheet" in the statement of invention refers to a single sheet or web as in direct thermography mentioned in the introduction, but also to the combination of a dye donor sheet or web with a receiving sheet or web.

Surprisingly we have found that an adjustment of the relative position of the thermal head with respect to the print drum to obtain minimal banding, also entails an improvement of two other types of defect. The first one is described by us as "woodiness" and is characterised by a plurality of grains given the sheet surface the outlook of a wood-like structure, whereas the second one is formed by a plurality of a very fine, hardly visible longitudinal streaks which apparently coincide with the boundary between adjacent heating elements.

Suitable embodiments of a thermal printer according to the invention are as follows.

Said adjustable stop means is formed by a rotatable cam, and said cam may be formed by an eccentrically mounted roller bearing. Said cam may be fixedly mounted on a rotatable shaft and said shaft may be provided with indication means for indicating its angular position.

The mentioned indication means may be in the form of a disc which is concentric with respect to the axis of rotation of said shaft, and which is provided with angularly distributed peripheral notches which can co-operate with a pin fixed on the sub-frame to lock the eccentric position of said cam.

Finally, the sub-frame may be movable from an inoperative position in which the head is remote of the drum to a printing position in which it is biased onto the drum.

Thermal printers of a type as described hereinbefore are known amongst others from U.S. Pat. No. 5,422,660 and JP-A-60 206 690. The adjustment of these known printers is less easy than that of the printer according to the patent invention.

BRIEF DESCRIPTION OF THE DRAWINGS

The invention will be described hereinafter with reference to the accompanying drawings, wherein.

DETAILED DESCRIPTION OF THE INVENTION

Detailed Description of the Drawings.

Figure 1:
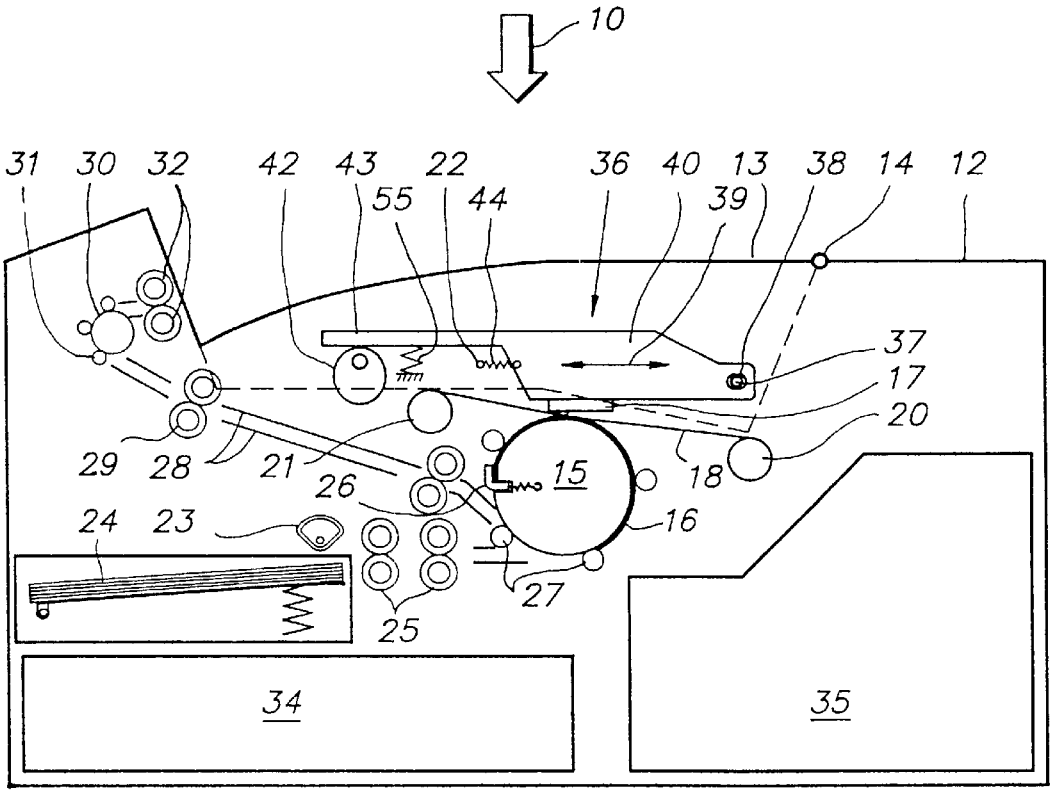
FIG. 1 is a diagrammatic view of one embodiment of a thermal printer which features the improvement according to the present invention, shown in the operative position.

FIG. 1 shows a diagrammatic representation of one embodiment of a thermal image recording apparatus according to the present invention.

The apparatus is mounted in a housing indicated generally by the arrow 10 having a base 12 and a lid 13 hinged to the base at 14, and generally comprises a print drum 15 which functions to support and transport a print-receiving sheet 16 past a thermal print head 17, and which is rotatably journalled in the main frame of the apparatus, not visible in this figure.

Thermal printing is effected by advancing a dye-bearing donor ribbon 18 between the print-receiving sheet 16 and thermal head 17.

The donor ribbon is unwound from a supply roll 20 and rewound on a winding roll 21. Both rolls are suitably fitted in a disposable cassette or a reloadable frame so that loading the apparatus with the donor ribbon is convenient.

A sheet to be printed is taken by rotatable finger 23 from a stack 24 of sheets and fed by roller pairs 25 to the printing drum which occupies at that moment an angular position allowing gripping of the leading end of the sheet by clamp 26. The lefthand side roller pair 25 suitably operates as a sheet separating mechanism to foraward one sheet only if accidentally two or even more sheets should have been removed by finger 23 from stack 24. Peripheral rollers 27 control the position of the sheet on the drum. A printed sheet is removed from the drum by reverse rotation of the drum so that the former trailing end of the sheet becomes now leading and enters guides 28, feed roller pairs 29 moving the sheet towards a heated drum 30 which neutralizes the curling introduced in the printed sheet by its heating by the thermal head. Idler rollers 31 keep the sheet in good thermal contact with drum 30, and roller pair 32 finally removes the sheet from the apparatus and disposes it on the curved topside of lid 13.

Block 34 comprises the electronic circuitry for controlling the sheet movements, the printing head positions and the drye ribbon transport whereas block 35 comprises the electronic circuitry for processing the image signal fed to the thermal head.

Thermal head 17 is mounted in a die-cast light metal member 36 forming a sub-frame which is mounted in lid 13 for pivoting about a stationary shaft 37.

The sub-frame fits on this shaft by means of an elongate bore 38 allowing adjustment in the direction of arrow 39 as will further be explained. The die-cast member has two parallel lateral walls such as wall 40 shown. A tension spring 44 attached at one end to a fixed point 22 of lid 13, and at the other end to sub-frame 36 biases the sub-frame in the left hand direction according to the figure.

The vertical position of the thermal head is controlled by a rotatable cam 42 engaging legs 43 of the sub-frame. The thermal head is shown in the operative position in FIG. 1, biasing spring means such as traction spring 55 biasing the frame towards the print drum. Line-wise heating causes dye transfer from donor ribbon 18 to print-receiving sheet 16 as drum 15 is driven to move sheet 16 together with donor ribbon 18 past the thermal head 17.

Figure 2:
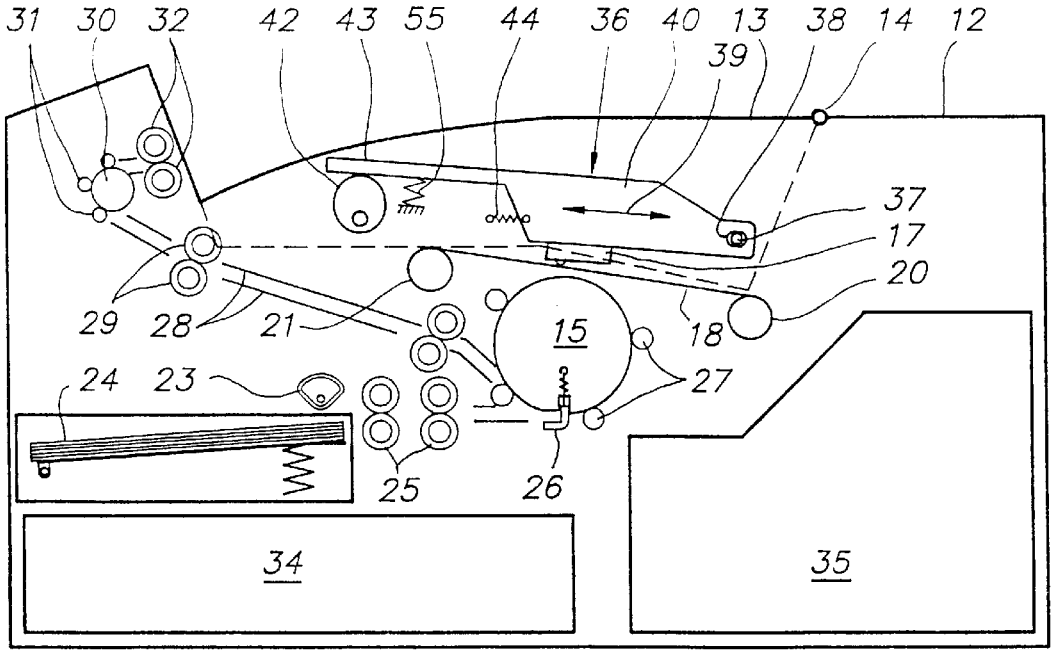
FIG. 2 is a diagrammatic view of the printer of FIG. 1 shown in its inoperative position.

As one color separation image has been printed, sub-frame 36 is raised by cam 42, see FIG. 2, so that the dye donor ribbon can be advanced to a next color separation frame, and drum 15 is rotated to bring sheet 16 in its initial position for starting the printing of a next color separation image in register with the first one. The sub-frame is likewise raised as a printed sheet is removed from the drum.

Figure 3:
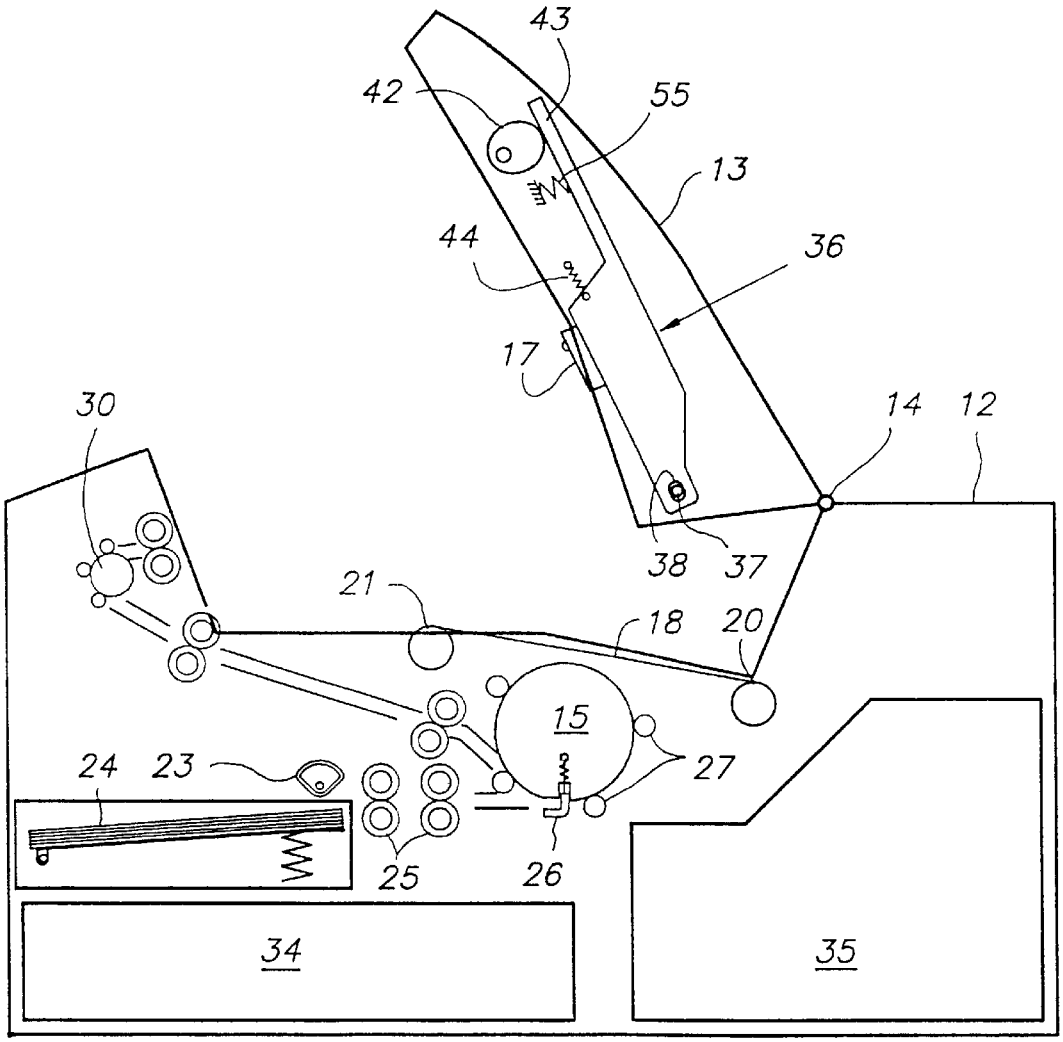
FIG. 3 is a diagrammatic view of the printer of FIG. 1, shown in the opened position.

FIG. 3 shows the apparatus in the opened position for replacement of the dye donor ribbon, for servicing, etc.

Figure 4:
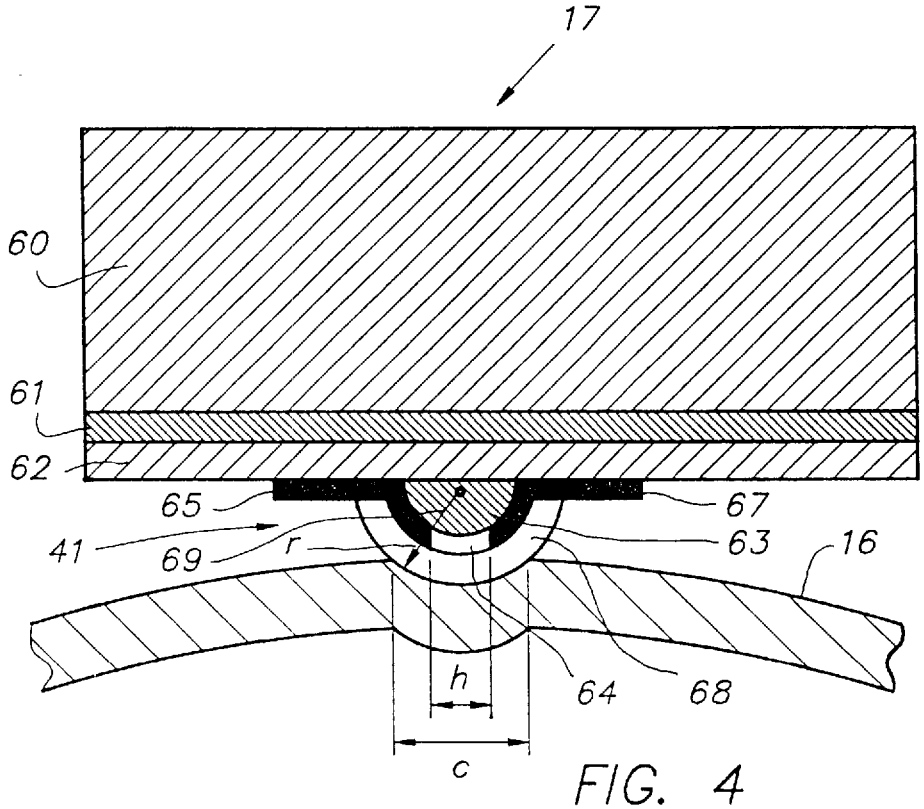
FIG. 4 is a diagrammatic cross-section of the thermal head of the printer of FIG. 1.

FIG. 4 shows a diagrammatic cross-section of thermal head 17.

The head comprises a heatsink 60, a bonding layer 61, a ceramic substrate 62 and the array 41 of juxtaposed thermal elements formed on a glass bead 63. Each element comprises a resistive heating element 64, electric connections 65 and 67 at either end thereof, and a wear resistant layer 68, e.g. glass. The curvature 69 of the heating elements is approximately cylindrical, the radius of curvature being r. The width of the heating zone of the head is indicated by h.

The centre of radius r has been shown as being located within glass bead 63, but it is clear that such centre can be also located within support 62 or heatsink 60, the angular extent of the heating elements being in such case less than 180°.

A sheet 16 which is supported on drum 15 is in bodily contact with the thermal elements over a width c which depends on the contact pressure and other parameters mentioned hereinbefore.

Figure 5:
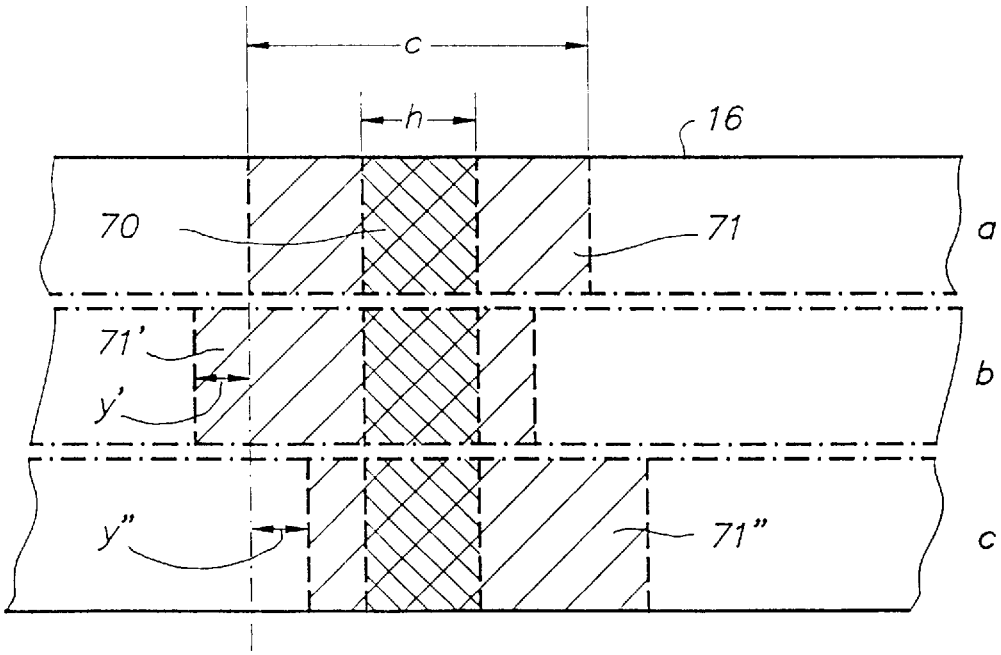
FIG. 5 is a diagrammatic plan view of a sheet, showing both the heating and the contact zone.

FIG. 5 is an enlarged diagrammatic plan view of sheet 16 showing the heating 70 and the contact zone 71, both being differently hatched for clearness sake.

It is clear that, as the angular location of the heating elements 64 on bead 63 changes, e.g. as a consequence of manufacturing tolerances of the head, the position of rectangle 70 within rectangle 71 will correspondingly change, thereby causing banding of the produced image, or woodiness or streaks as described hereinbefore. The inventive adjustment of the relative position of drum and thermal elements allows to overcome the consequences of such incorrect position of the elements on the head.

One embodiment of suitable adjustment means is described hereinafter with reference to FIGS. 6 to 8 which diagramatically show a central, an extreme rearward and an extreme forward position, respectively, of thermal head 17 with respect to print drum 15. The terms rear- and forward stand in the present example in relation to the direction of advance of a sheet past the print head.

Sub-frame 36, which carries thermal head 17, is provided on both its lateral sides with a cam 46 fitted on a small shaft 47. The shaft is rotatably journalled in a corresponding bore of the sub-frame.

Figure 7:
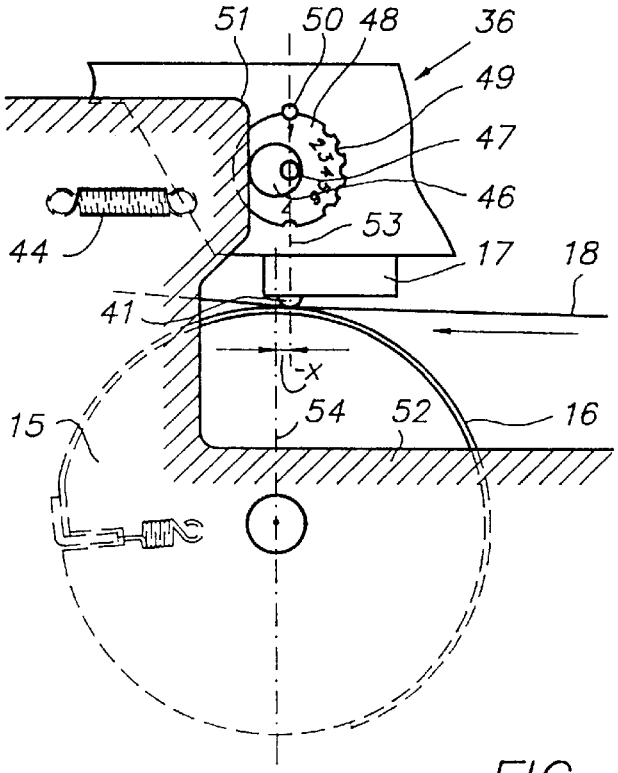
FIG. 7 shows the mechanism of FIG. 6, with the head in a rearward position.

Shaft 47 is provided with an index disc 48 which has angularly spaced notches 49 bearing identification numbers from 1 to 7, see FIG. 7, which can co-operate with a pin 50 fixedly attached to the sub-frame. Cams 46 bear on a reference surface 51 which is nothing else than a vertical edge of the main frame 52 of the apparatus in which, among others, printing drum 15 is journalled. The main frame has diagrammatically been illustrated by the hatched part of the drawing.

Tension spring 44 biases sub-frame 36 in the left hand direction according to the drawing, i.e. forward as defined hereinbefore, the contact of cam 46 with face 51 exactly determining the relative position of sub-frame 36 with respect to main frame 52. In this way the position of thermal head 17, more precisely of its thermal elements 41, with respect to the element which controls the position of the print-receiving sheet, viz. drum 15, is determined. Slots 38 of the sub-frame, see FIGS. 1 to 3, allow the described adjustments of this frame which, in the present case, are tangential to the drum.

Figure 6:
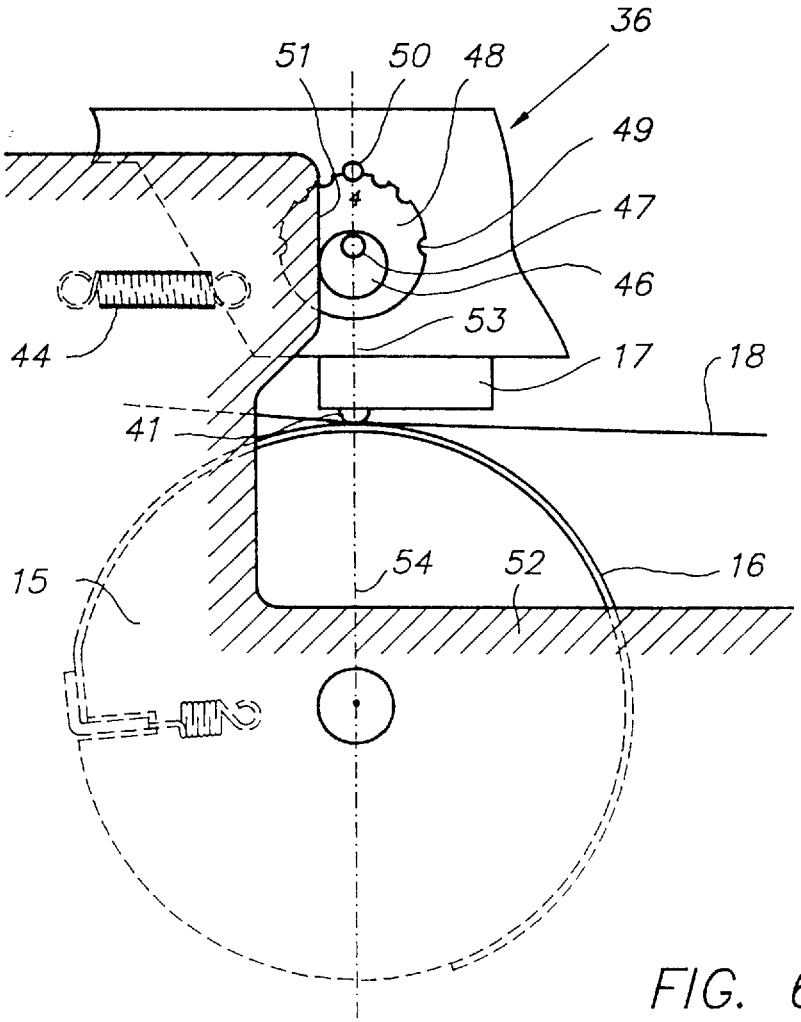
FIG. 6 is an enlarged view of the adjustment mechanism of the thermal head of the printer of FIG. 1, the head being shown in its central position.

FIG. 6 shows the neutral position of the thermal head, the central axis 53 of the thermal elements coinciding with the vertical 54 through the drum axis. In this position notch N° 4 is in engagement with pin 50.

FIG. 7 shows the most rearward position of the thermal head, i.e. for notch N° 1. In this position, the lateral adjustment −x between lines 53 and 54 can amount up to approximately 1.2 mm. The contact zone between sheet 16 (plus ribbon 18) and the heating elements is now no longer located centrally on these elements but instead slightly forwardly thereof, as shown by 71' in FIG. 5*b*. The lateral displacement y' between contact zone heating zone amounts in the present example to 80 $\mu$m, for the radius of the heating elements being 3.0 mm and the radius R of the printing drum being 45 mm.

Figure 8:
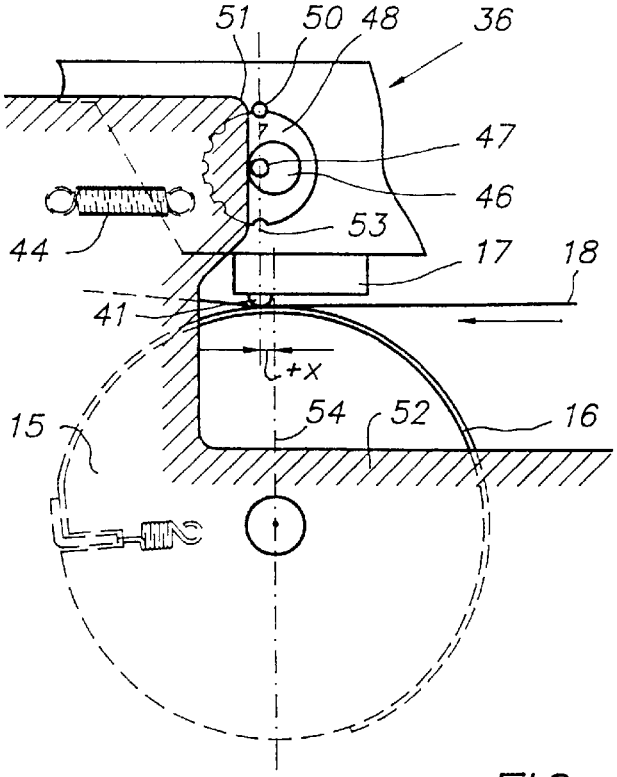
FIG. 8 shows the mechanism of FIG. 6, with the head in a forward position.

FIG. 8 shows the most forward position of the thermal head, i.e. for notch N° 7. In this position, the lateral adjustment x between lines 53 and 54 can amount to approximately 1.2 mm. The contact zone between sheet 16 and the heater elements is now displaced rearwardly on these elements, see 71" in FIG. 5*c*. The lateral adjustment y" between contact zone and heating zone amounts in the present example to 80 $\mu$m, for the radii of heating elements and drum mentioned hereinbefore.

The adjustment which yields optimum results is in practice found on the basis of series of tests during which the adjustment of the thermal head is changed from the most rearward to the most forward position. The setting of the cam position which yields optimum results can than be marked on the head so that the head, as it has been removed for servicing of the apparatus, for remedying a paper jam, etc., can be replaced in exactly the same position. It should be understood that the settings of both cams should always be identic in order to keep the row of thermal elements strictly parallel to the axis of drum 15.

Figure 9:
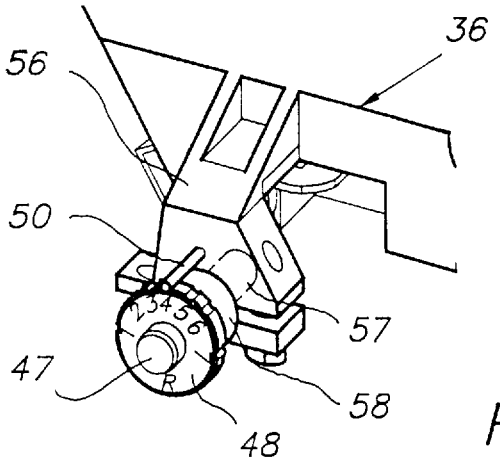
FIG. 9 is a perspective view of the adjustment mechanism of FIG. 6.

The description hereinbefore made it clear that for each color print the thermal head will be four times raised and next re-adjusted by the cams to get its correct printing position. The contact between a cam 46 and its reference face 51 is therefore preferably replaced a rolling one and this becomes apparent from FIG. 9 which shows a practical arrangement of a cam adjustment mechanism.

Sub-frame 36 is provided on both its lateral sides, one only being shown, with an extension 56 which is angled downwardly and which is in fact an integral part of the sub-frame.

Extension 56 has a bore 57 aligned with the drum axis, and shaft 47 of the cam mechanism fits in said bore. The cam is constituted by a conventional roller bearing 58 mounted eccentrically on shaft 47. The free extremity of shaft 47 bears adjustment disc 48, the peripheral notches of which co-operate with pin 50. Adjustment occurs by pulling out the cam mechanism, changing its angular position, and re-inserting its shaft in the bore of the sub-frame. Locking means may be provided for locking the shaft in the bore. The adjustment mechanism can be suitably marked, e.g. by an R or L, see "R" in FIG. 9 to avoid interchanging a left- and righthand one.

The following patent rights of the present assignee relate to thermographic materials and processes for use with the apparatus according to the present invention.

Materials

WO 95/12495 relating to a protected heat-sensitive recording material in a direct thermal imaging method, EP 0669876 relating to a thermal imaging material, EP 0669875 relating to a thermal imaging material, Process EP 0679519 A2 relating to a thermal dye transfer printing process, EP 0627319 A1 relating to a method for connecting across-the-head uneveness in a thermal printing system, Apparatus EP 0602284 A1 relating to a thermal image-recording apparatus with sensor means for sensing the type of print sheet, EP 0671276 A1 relating to a thermal printer comprising a "real-time" temperature estimation, and Packaging EP 0593821 A1 relating to a dye ribbon package for loading the reloadable cassette of a thermal printer.

We claim:

1. A thermal printer with a thermal head having a plurality of heating elements juxtaposed in an elongate array, a rotatable print drum for conveying a sheet past said heating elements while said heating elements are urged towards said sheet on said print drum, and means for adjusting the relative position of said thermal head with respect to said print drum, in a direction forward or rearward with respect to the direction of advance of said sheet, said thermal printer comprising:

a main frame in which said printing drum is rotatably mounted, said main frame comprising a reference face;

a sub-frame in which said thermal head is mounted, said sub-frame being movable relatively to the print drum in a direction tangential thereto;

spring means for biasing said sub-frame in one sense of said tangential direction; and adjustable stop means on said sub-frame which can abut against said reference face of said main frame, under the bias of said spring means.

2. The thermal printer according to claim 1, wherein said adjustable stop means is formed by a rotatable cam.

3. The thermal printer according to claim 2, wherein said cam is formed by an eccentrically mounted roller bearing.

4. The thermal printer according to claim 2, wherein said cam is fixedly mounted on a rotatable shaft, and said shaft is provided with indication means for indicating its angular position.

5. The thermal printer according to claim 4, wherein:

said sub-frame comprises a pin for locking the eccentric position of said cam; and said indication means comprises a disc, which is concentric with respect to the axis of rotation of said shaft, comprising angularly distributed peripheral notches which can co-operate with said pin fixed on said sub-frame.

6. The thermal printer according to claim 5, wherein said notches are numbered.

7. The thermal printer according to claim 1, wherein said sub-frame is movable from an inoperative position in which said thermal head is remote from said print drum to a printing position in which said thermal head is biased towards the drum.

* * * * *